US010203090B1

(12) United States Patent
Zhu

(10) Patent No.: US 10,203,090 B1
(45) Date of Patent: Feb. 12, 2019

(54) RETRACTABLE ROTATABLE LED LAMP

(71) Applicant: Haiying Zhu, Yuyao (CN)

(72) Inventor: Haiying Zhu, Yuyao (CN)

( * ) Notice: Subject to any disclaimer, the term of this patent is extended or adjusted under 35 U.S.C. 154(b) by 0 days.

(21) Appl. No.: 15/972,214

(22) Filed: May 6, 2018

(30) Foreign Application Priority Data

Nov. 2, 2017 (CN) ..... 2017 1 1065732

(51) Int. Cl.

| | |
|---|---|
| ***F21V 14/02*** | (2006.01) |
| ***F21V 17/02*** | (2006.01) |
| ***F21V 17/18*** | (2006.01) |
| ***F21V 21/30*** | (2006.01) |
| ***F21L 4/04*** | (2006.01) |
| ***F21V 21/14*** | (2006.01) |
| *F21Y 115/10* | (2016.01) |

(52) U.S. Cl.
CPC ..... *F21V 14/025* (2013.01); *F21L 4/04* (2013.01); *F21V 17/02* (2013.01); *F21V 17/18* (2013.01); *F21V 21/145* (2013.01); *F21V 21/30* (2013.01); *F21Y 2115/10* (2016.08)

(58) Field of Classification Search
CPC ..... F21V 14/025; F21V 17/18; F21V 21/30; F21V 21/145; F21V 17/02; F21L 4/04; F21Y 2115/10
See application file for complete search history.

(56) References Cited

U.S. PATENT DOCUMENTS

2005/0030737 A1* 2/2005 Chen ..... B60Q 7/00 362/102
2012/0262089 A1* 10/2012 Lo ..... F21V 19/0015 315/297
2016/0186967 A1* 6/2016 Mathews ..... F21V 21/30 362/368

FOREIGN PATENT DOCUMENTS

CN 201666465 U 12/2010

* cited by examiner

*Primary Examiner* — Kevin Quarterman
(74) *Attorney, Agent, or Firm* — Gokalp Bayramoglu

(57) ABSTRACT

An LED lamp includes a lamp holder; a lamp body; and a retractable rotatable mechanism having a gear seat arranged on the lamp body. A central hole of the gear seat has a gear. Two sides of the central hole are symmetrically provided with deep holes. Each deep hole has a first elastic body. One end of the first elastic body contacts the bottom of the deep hole, the other end of the first elastic body contacts a latch engaged with the gear. One end of a retractable rod is connected to the gear, and the other end of the retractable rod is hinged to a threaded rod. The threaded rod is arranged on a fixing box. A first convex column and a second convex column extend out from two sides of the fixing box. A second elastic body is arranged between the first convex column and the second convex column.

14 Claims, 11 Drawing Sheets

RETRACTABLE ROTATABLE LED LAMP

CROSS REFERENCE TO RELATED APPLICATIONS

This application is based upon and claims priority to Chinese Patent Application CN2017110657329, field on Nov. 2, 2017, the entire content of which is incorporated herein by reference.

TECHNICAL FIELD

The present invention relates to the technical field of LED lamps, in particular to a retractable rotatable LED lamp.

BACKGROUND

Similar LED lamps in the prior art have been disclosed in the following patent documents.

The specification of Chinese utility model patent CN 201666465 U (published on Dec. 8, 2010) discloses a rotation mechanism of a flashlight mainly composed of shell, base, elastic piece and base cover. The upper part of the shell is an accommodating cavity for installing the lamp, the lower part of the shell is rotatably hinged on the base, and a circle of small protrusion and shallow groove, which are spaced from each other, is formed around the hinge point. The base is a cylindrical member which may be sleeved at the lower part of the shell. The elastic piece may be inserted into the gap between the base and the lower part of the shell and movably fitted in the shallow groove at the lower part of the shell. The base cover may be snap-fit to the outer end of the base. The swing mechanism of the utility model is composed of the elastic piece, the small protrusion and the shallow groove at the lower part of the shell. The swing mechanism would be assembled merely by inserting the elastic piece into the gap between the base and the lower part of the shell, and then snap-fitting the base cover. When the elastic piece is damaged, the swing mechanism would be repaired merely by replacing the damaged elastic piece, so the repair is easy.

However, although such LED lamp is convenient to some extent, since the shell can merely be rotated at certain angle, the lighting angle is still limited, thus affecting the use. A further improvement is required.

SUMMARY

The objective of the present invention is to provide a retractable rotatable LED lamp to solve the problems raised in the above-mentioned background.

In order to achieve the objective, the technical solution provided by the present invention is as follows. An LED lamp includes a lamp holder, a lamp body, and a retractable rotatable mechanism. The lamp body performs a retraction and a rotation on the lamp holder through the retractable rotatable mechanism. The retractable rotatable mechanism includes a gear seat arranged on the lamp body. A central hole of the gear seat is provided with a gear. Two sides of the central hole are symmetrically provided with deep holes. The deep holes are each provided with a first elastic body. One end of the first elastic body contacts the bottom of the deep hole, the other end of the first elastic body contacts a latch, and the latch is engaged with the gear. One end of a retractable rod is connected to the gear, and the other end of the retractable rod is hinged to a threaded rod. The threaded rod is arranged on a fixing box. A first convex column and a second convex column extend from two sides of the fixing box respectively. A second elastic body is arranged between the first convex column and the second convex column. Two sides in the lamp housing of the lamp holder are symmetrically provided with a first convex column guide rail and a second convex column guide rail. The first convex column guide rail or the second convex column guide rail includes a first groove, a concave strip connected to the first groove, and a second groove connected to the concave strip. The first convex column contacts the first convex column guide rail, the second convex column contacts the second convex column guide rail. The lamp cover of the lamp holder is provided with an opening for the threaded rod to be folded and fitted in.

Further, a plurality of elastic pads and an adjusting nut are sleeved on the threaded rod.

Further, the upper part and the lower part of the lamp housing are respectively provided with a guide strip and a guide column. The guide strip and the guide column are respectively matched with a guide strip groove and a guide column groove on the fixing box.

Further, the bottom of the lamp shell is provided with a magnetic body.

Further, the lamp body includes a shell, and a front part of the shell is provided with an LED light.

Further, the shell is further provided with a battery for supplying power to the LED light.

Further, the shell is provided with at least one hook.

Further, the hook is hidden in a hook slot of the shell.

Further, both the first elastic body and the second elastic body are springs.

Further, the opening set on the lamp cover is a one-way opening.

Compared with the prior art, the advantages of the present invention are as follows. The lamp body is not only axially retractable on the lamp holder, but also 360°-rotatable relative to the lamp holder so as to illuminate. Moreover, the lamp body can also illuminate by folding. Therefore, the present invention realizes the omnidirectional illumination of the LED lamp through a simple structure.

DETAILED DESCRIPTION OF THE EMBODIMENTS

Hereinafter, the technical solutions in the embodiments of the present invention will be clearly and completely described with reference to the drawings of the embodiments of the invention. Apparently, the embodiments are merely some of the embodiments of the invention rather than all. Any other embodiment derived from the embodiments of the present invention by those skilled in the art without creative effort shall fall within the scope of the present invention.

Figure 1:
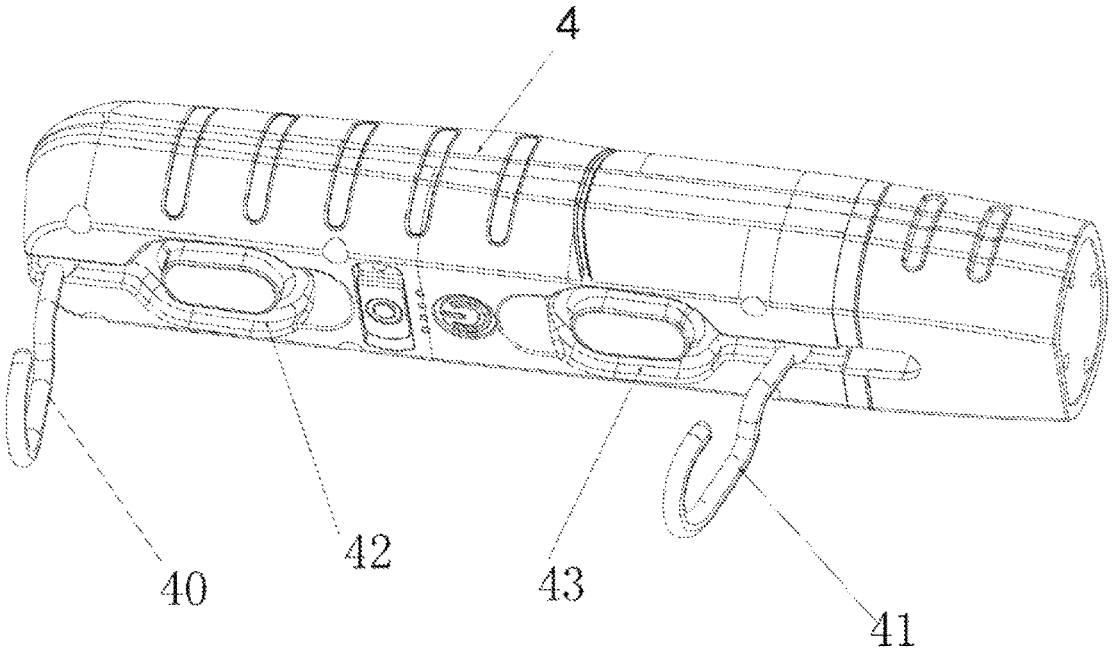
FIG. 1 is a schematic view showing the stereoscopic use structure of the retractable rotatable LED lamp of the present invention.
Figure 2:
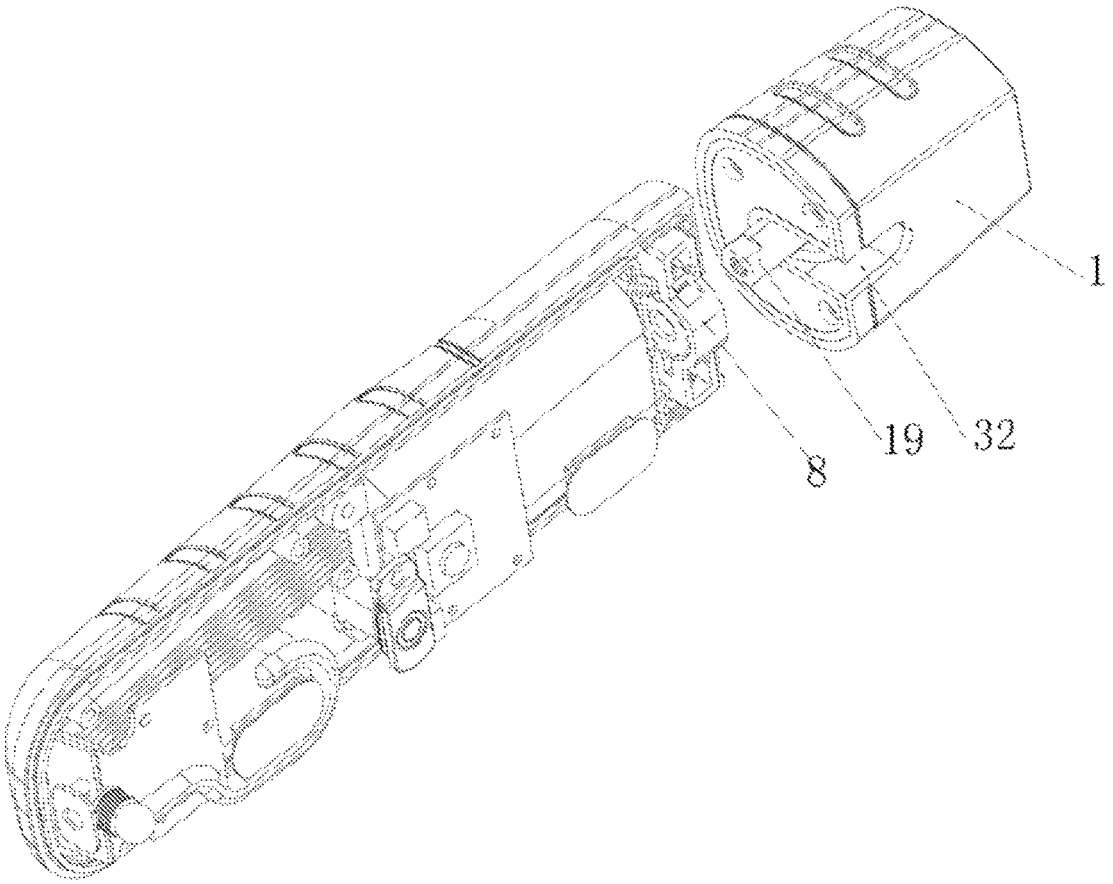
FIG. 2 is a partially exploded view of the retractable rotatable LED lamp of the present invention.
Figure 3:
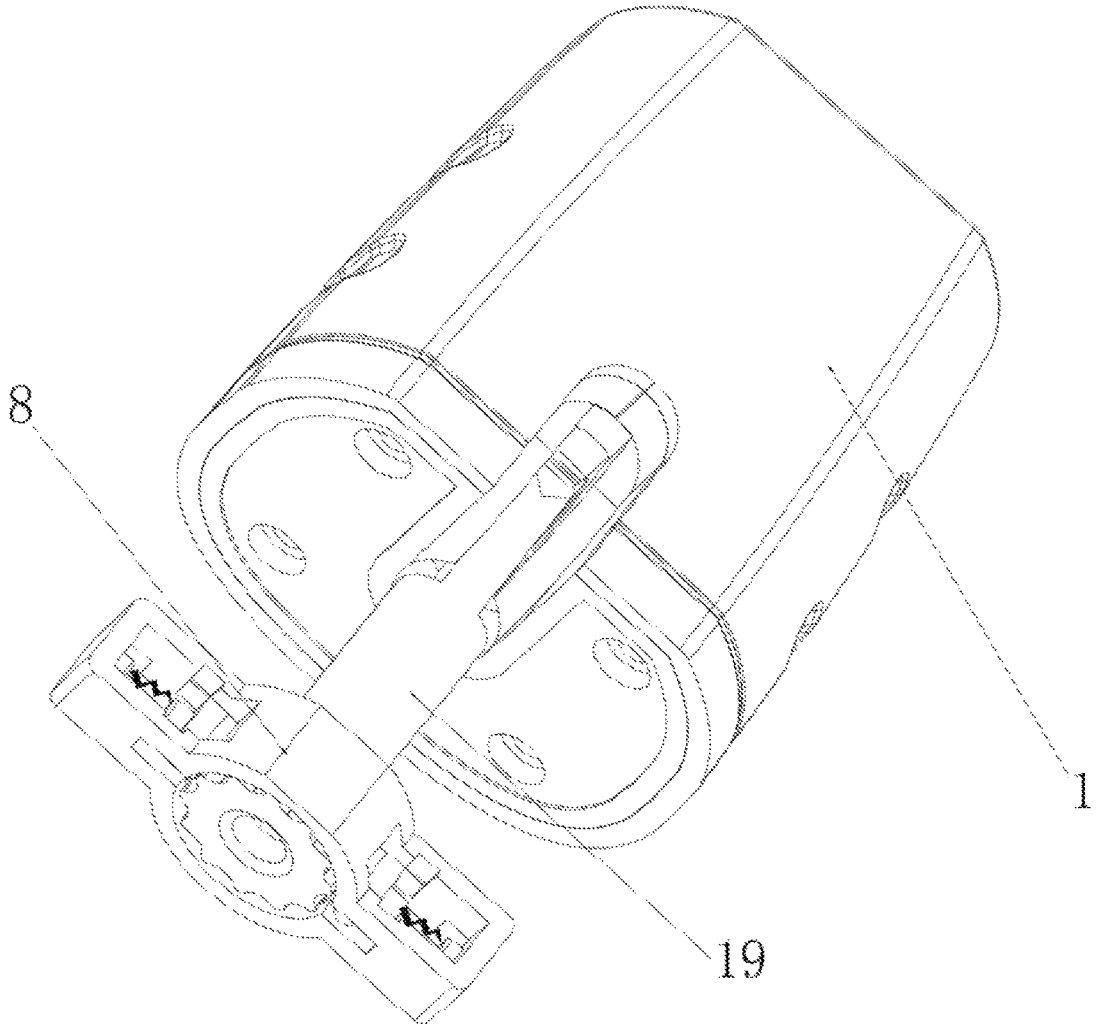
FIG. 3 is a first partially structural schematic view of the retractable rotatable LED lamp of the present invention.
Figure 4:
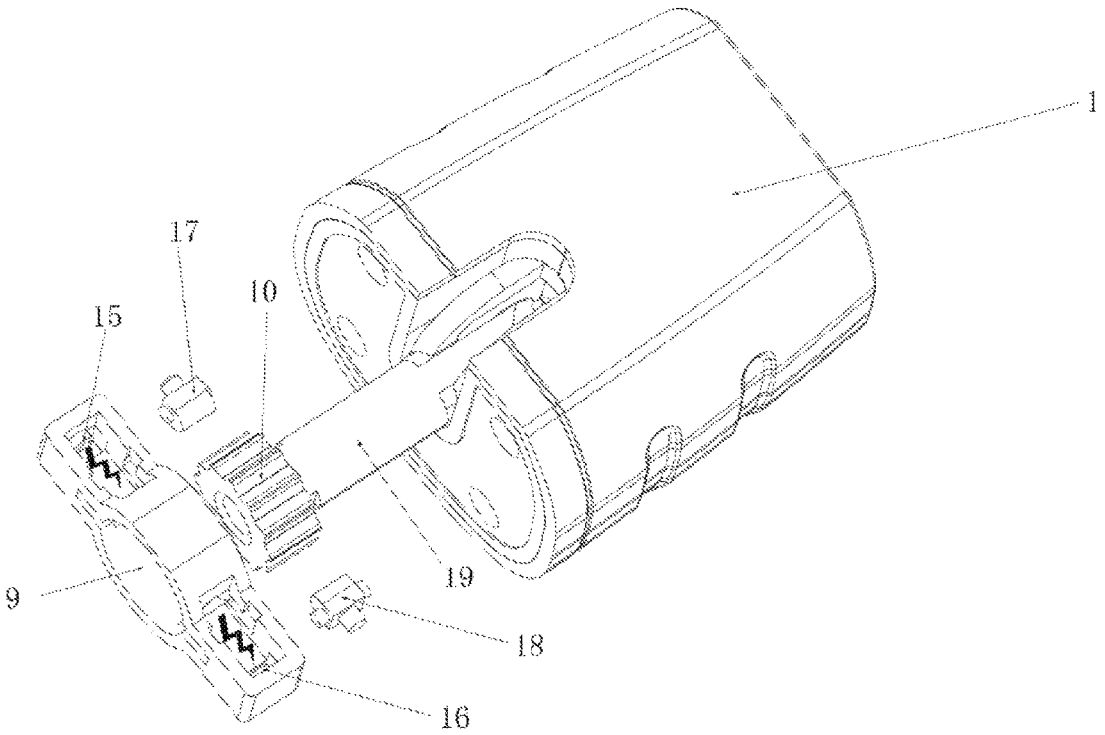
FIG. 4 is a first partially exploded structural schematic view of the retractable rotatable LED lamp of the present invention.
Figure 5:
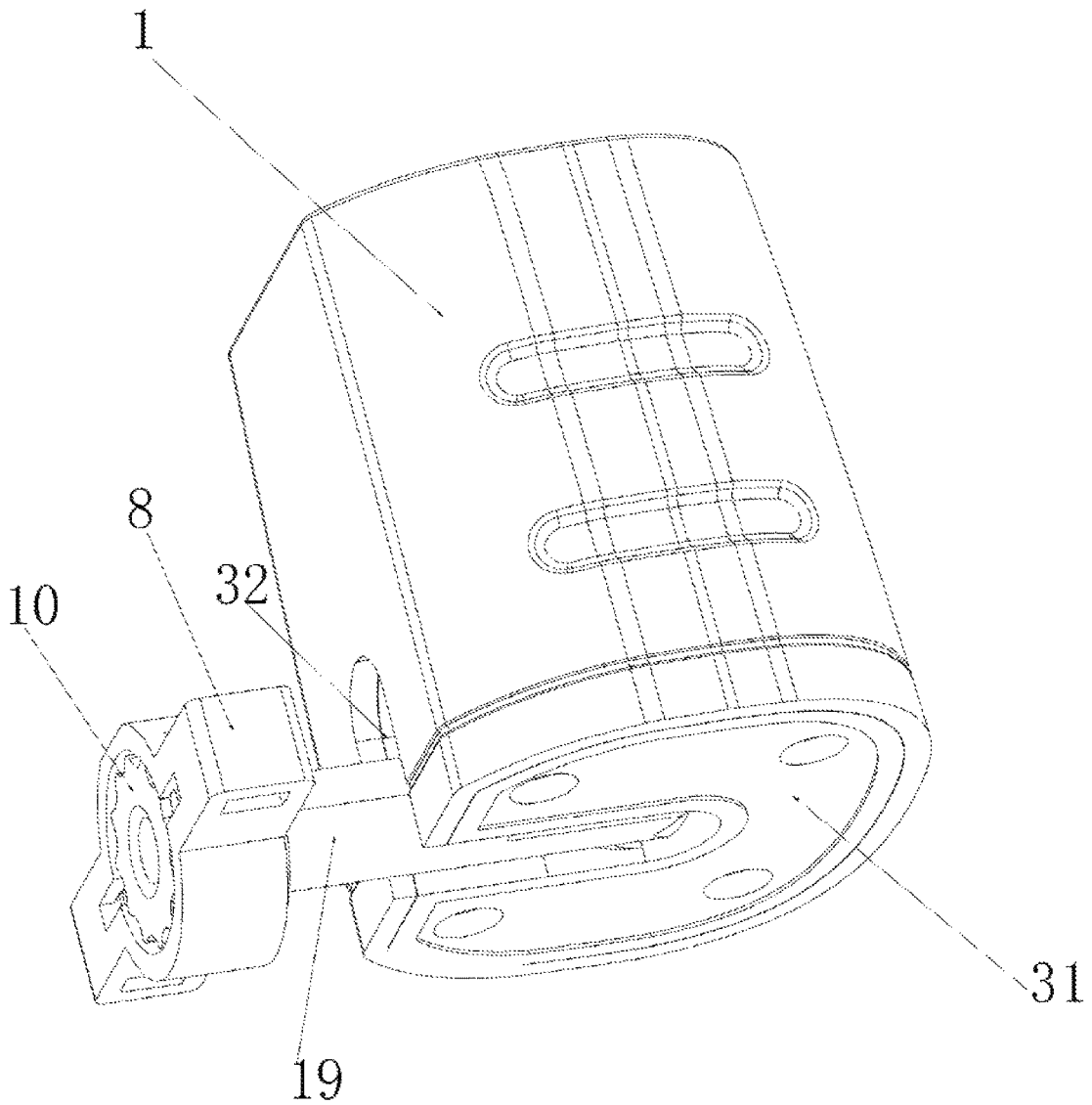
FIG. 5 is a schematic view showing the partially using structure of the retractable rotatable LED lamp of the present invention.
Figure 6:
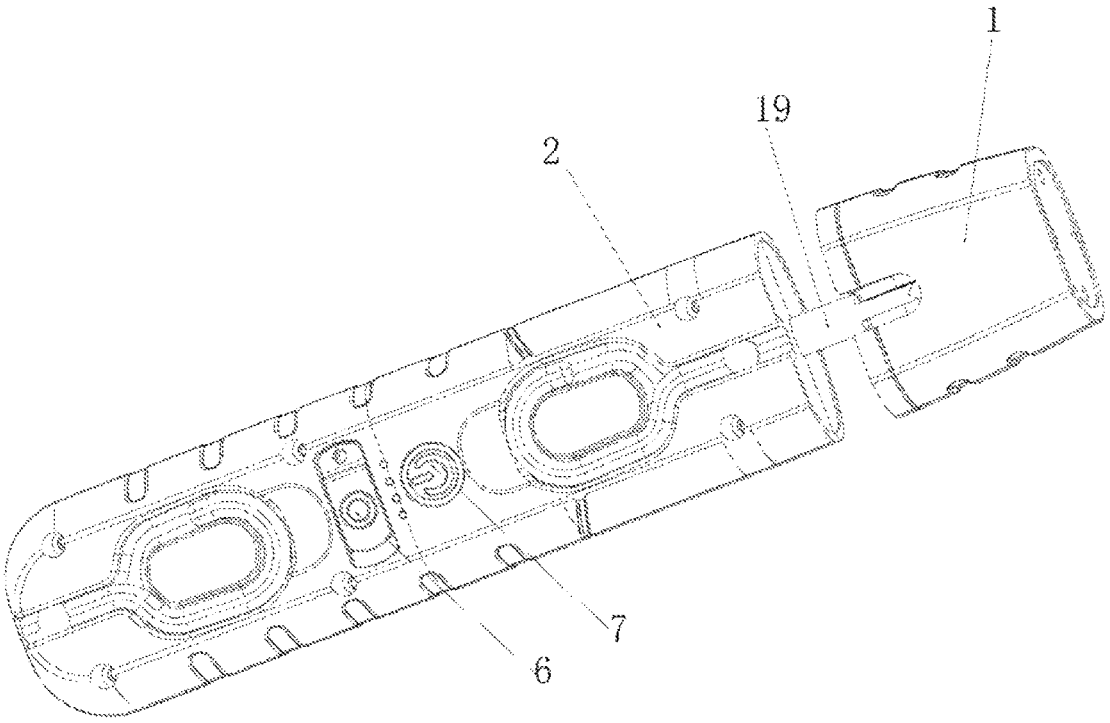
FIG. 6 is a first schematic view showing the using structure of the retractable rotatable LED lamp of the present invention.
Figure 7:
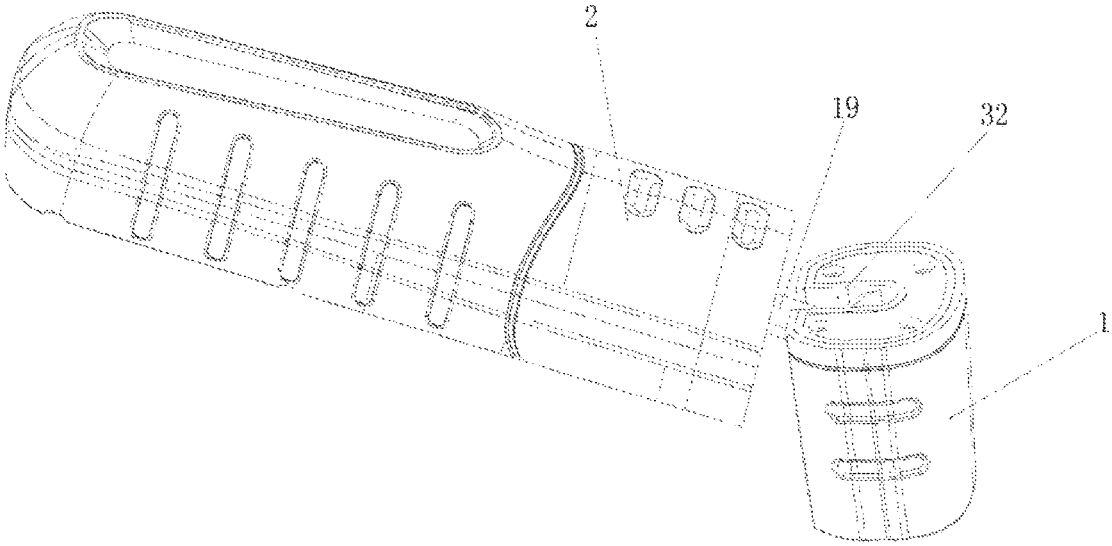
FIG. 7 is a second schematic view showing the using structure of the retractable rotatable LED lamp and rotation of the present invention.
Figure 8:
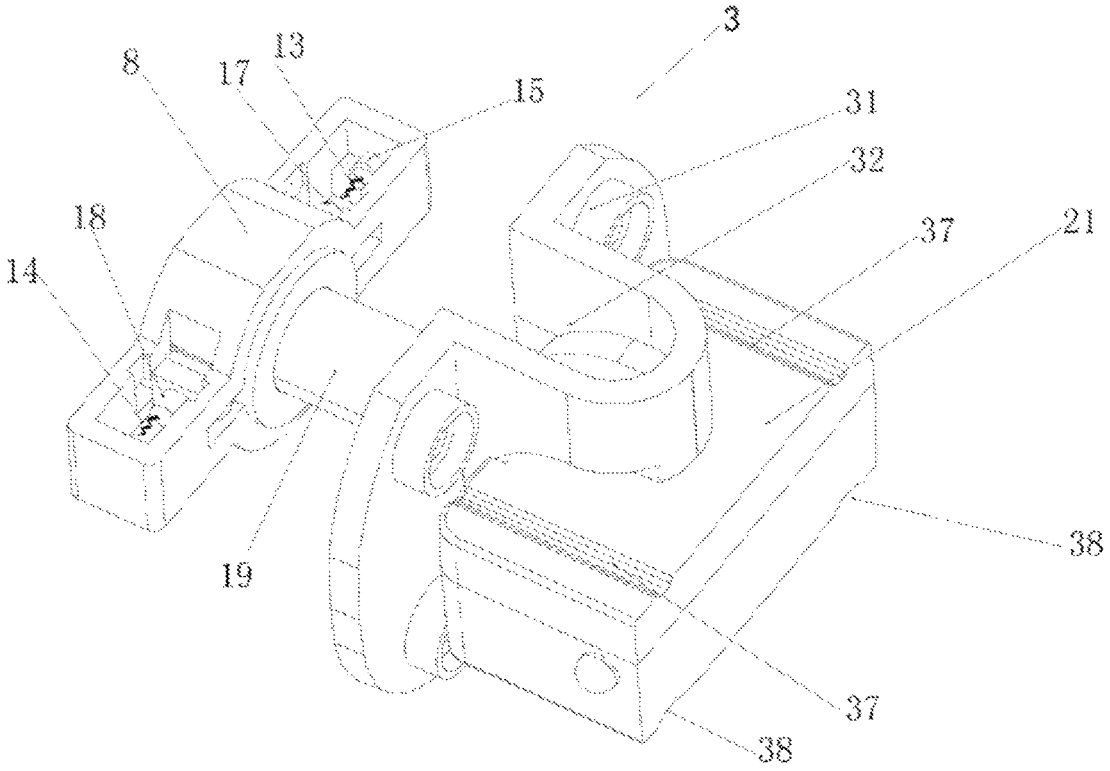
FIG. 8 is a second partially structural schematic view of the retractable rotatable LED lamp of the present invention.
Figure 9:
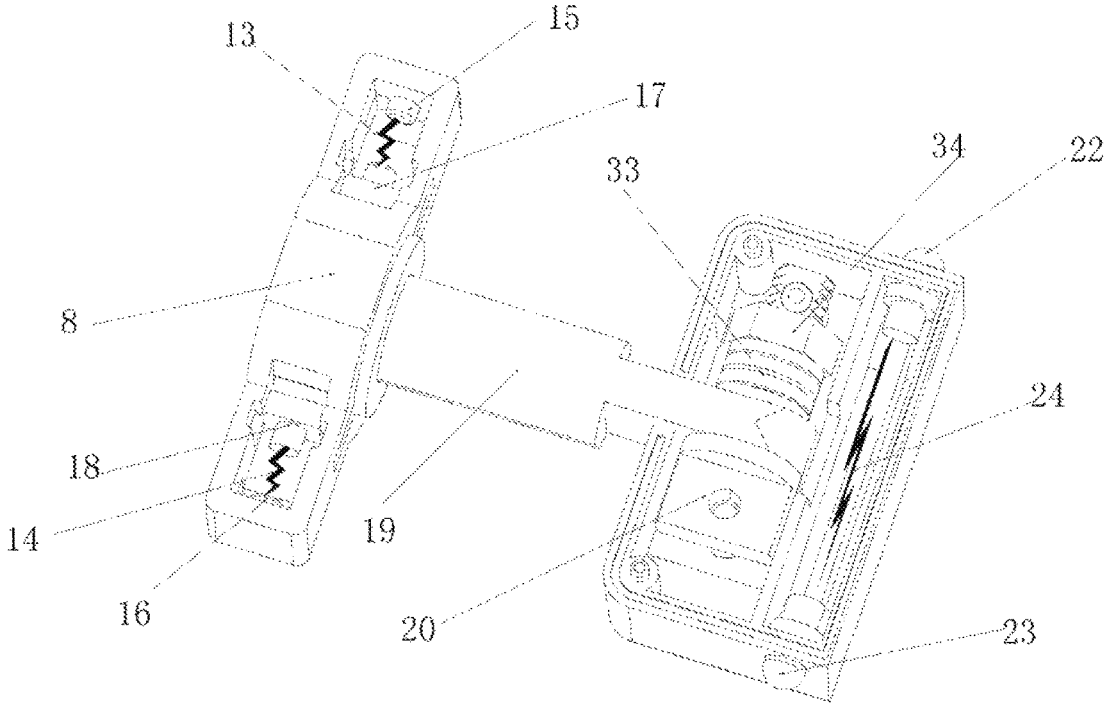
FIG. 9 is a third partially structural schematic view of the retractable rotatable LED lamp of the present invention.
Figure 10:
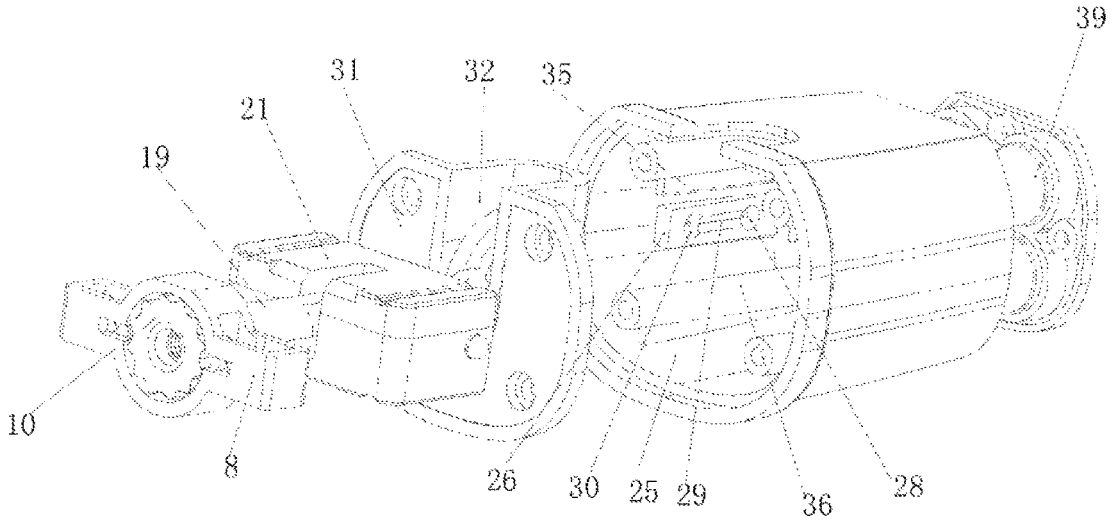
FIG. 10 is a second partially exploded structural schematic view of the retractable rotatable LED lamp of the present invention.
Figure 11:
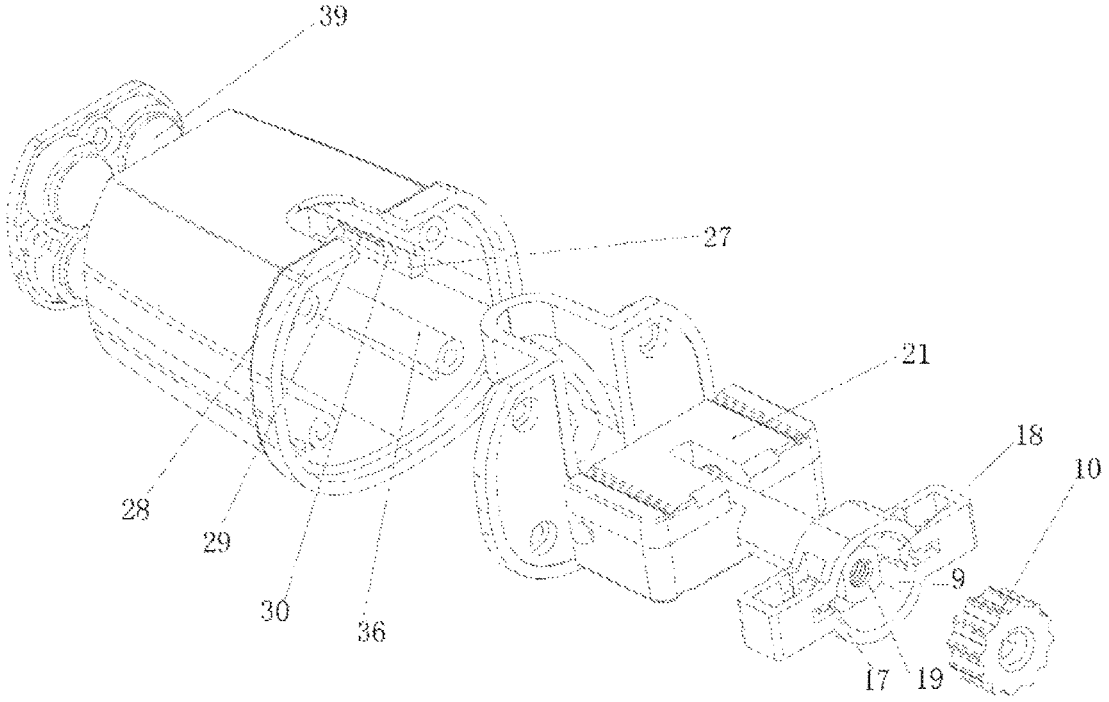
FIG. 11 is a third partially exploded structural schematic view of the retractable rotatable LED lamp of the present invention.
Figure 12:
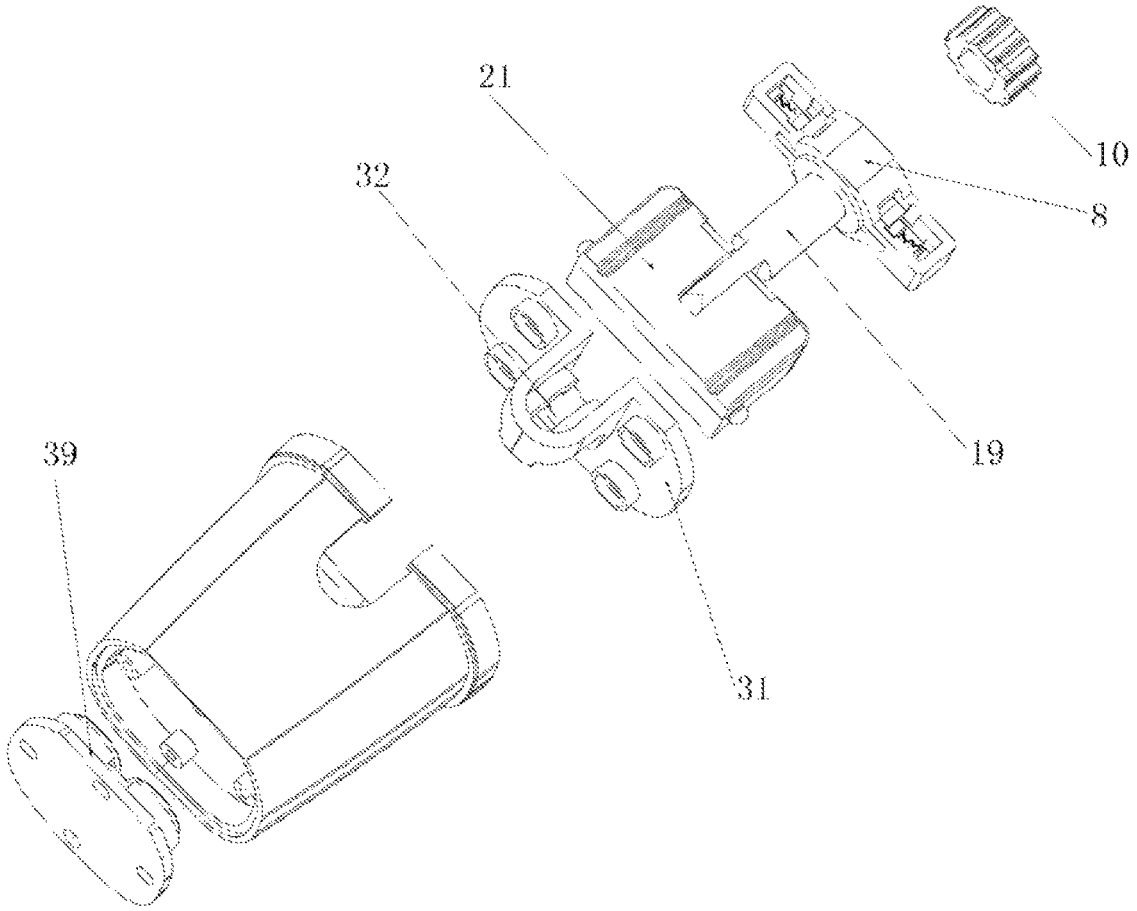
FIG. 12 is a fourth partially exploded structural schematic view of the retractable rotatable LED lamp of the present invention.
Figure 13:
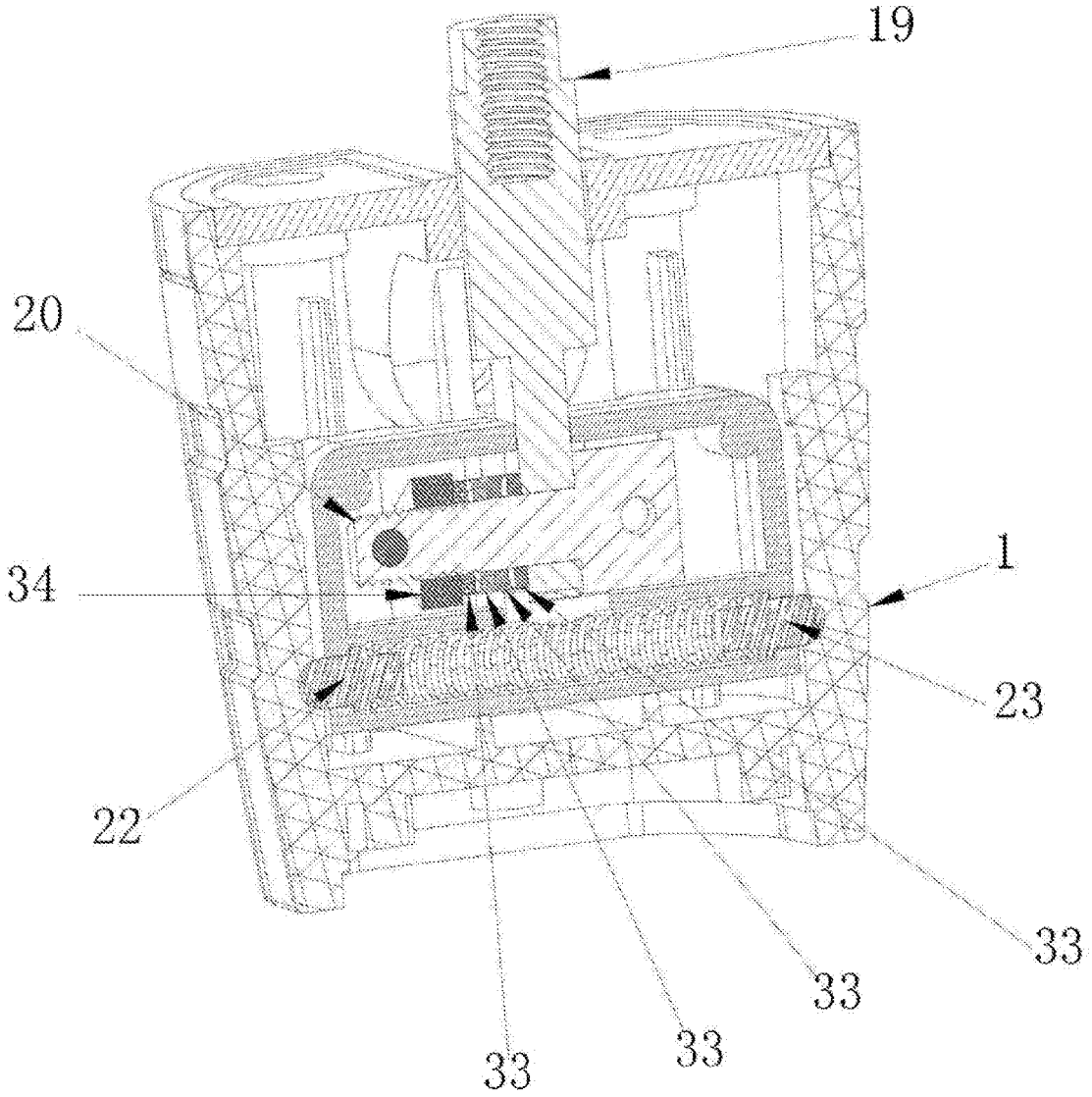
FIG. 13 is a sectional structural schematic view showing a retracted state of the retractable rotatable LED lamp of the present invention.
Figure 14:
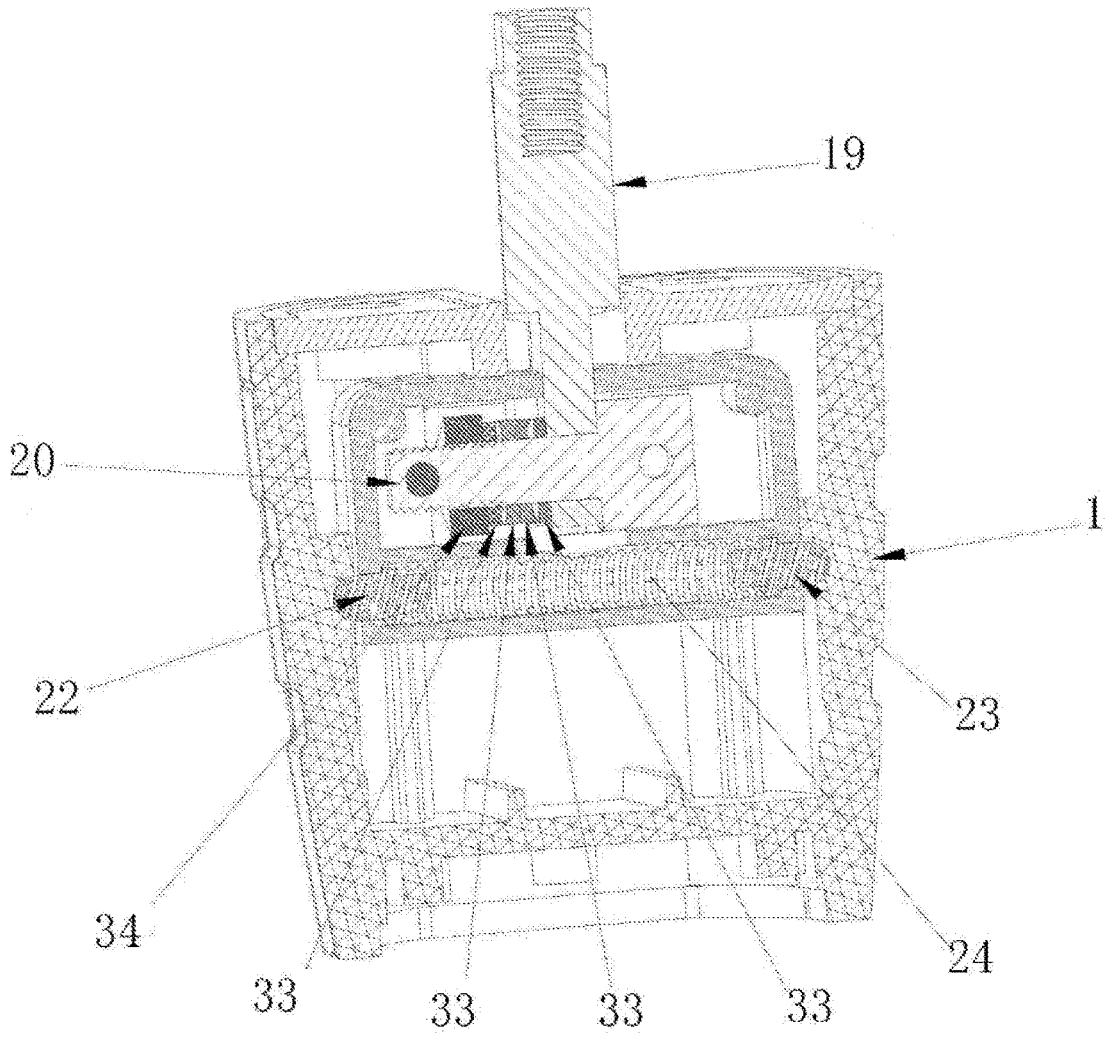
FIG. 14 is a sectional structural schematic view showing an extension state the retractable rotatable LED lamp of the present invention.

The present invention provides a retractable rotatable LED lamp, as shown in FIGS. 1, 2, 3, 4, 5, 6, 7, 8, 9, 10, 11, 12, 13 and 14. The retractable rotatable LED lamp includes lamp holder 1, lamp body 2, and retractable rotatable mechanism 3. The lamp body performs retraction and rotation on the lamp holder by the retractable rotatable mechanism so as to realize omnidirectional lighting. The lamp body includes shell 4. The front part of the shell is sequentially provided with transparent lid, LED light and lampshade. The shell is also provided with a battery for supplying power to the LED light. When the switch 6 is pressed down, the battery supplies power to the LED light for illumination. Light intensity adjusting button 7 is further arranged beside the switch 6. The retractable rotatable mechanism includes gear seat 8 arranged on the lamp body. Central hole 9 of the gear seat is provided with gear 10. Two sides of the central hole are symmetrically provided with deep holes 11, 12. The deep holes are provided with first elastic bodies 13 and 14. The first elastic bodies each have an end contacting boss 15 or 16 at the bottom of the deep holes, and the first elastic bodies each have another end contacting latch 17 or 18. The latch is engaged with the gear. When the lamp body is required to be rotated at 360 degrees, the user merely needs to rotate the lamp body with a slight force. The principle is that the gear 10 would rotate as a result of rotating the lamp body, and when the gear rotates to the top, the latches 17 and 18 would be pushed out, and since the spring is located in the rear of the latches 17 and 18, the latches 17 and 18 would retract until the lamp body stops rotating, then the latches 17 and 18 would be pushed back to the bottom of the gear by the springs due to the action of the springs. One end of the retractable rod 19 is connected to the gear, and the other end of the retractable rod 19 is hinged with the threaded rod 20. The threaded rod is arranged on the fixing box 21. First convex column 22 and second convex column 23 respectively extend out from two sides of the fixing box. Second elastic body 24 is arranged between the first convex column and the second convex column. First convex column guide rail 26 and second convex column guide rail 27 are symmetrically arranged on two sides inside the lamp housing 25 of the lamp holder. The first convex column guide rail or the second convex column guide rail includes first groove 28, concave strip 29 connected to the first groove, and second groove 30 connected to the concave strip. The first convex column contacts the first convex column guide rail, and the second convex column contacts the second convex column guide rail. The lamp body may be axially extended or retracted with respect to the lamp holder. When the lamp body is retracted to the lamp holder, the first convex column 22 and the second convex column 23 respectively extend out from both sides of the fixing box, and the spring arranged between the first convex column 22 and the second convex column 23 would tightly press the first convex column 22 and the second convex column 23 to the first groove 28. Otherwise, when the lamp body is extended out of the lamp holder, since a pull force from the user is applied, the first convex column 22 and the second convex column 23 would be pulled into the second groove 30 through the concave strip 29. In order to ensure the extension reliability, the upper part and the lower part inside the lamp shell are respectively provided with the guide strip 35 and the guide column 36. The guide strip and the guide column are respectively matched with the guide strip groove 37 and the guide column groove 38 on the fixing box, so as to further ensure the reliability of pulling the lamp body out of the lamp holder. When the lamp body should be folded at 0°-100° for illumination, the lamp cover 31 of the lamp holder is provided with opening 32 for the threaded rod to be fitted in. The size of the opening is right for a front part of the threaded rod to be fitted in. The opening formed on the lamp cover is a one-way opening for increasing the rotation range of the lamp body. The first elastic body and the second elastic body are both springs.

In order to ensure the stability of the opening 32 for the threaded rod to be fitted in, four elastic pads 33 and adjusting nuts 34 are sleeved on the threaded rod. By doing so, a tight fitting is provided when the retractable rod rotates relative to the threaded rod, so it is convenient for the user to adjust and position the direction of the lamp body in use. Moreover, if the retractable rod is loosened, the adjusting nuts may be adjusted to a fastened state to ensure the best use state.

In order to fix the LED lamp to an iron workbench, the bottom of the lamp housing is provided with a magnetic body 39 so that the lamp housing would be adsorbed to the iron workbench.

In order to suspend the LED lamp for illumination, two hooks 40, 41 are provided on the shell. When not in use, the hooks are hidden in the hook slots 42, 43 of the shell.

The lamp body of the present invention is not only axially retractable on the lamp holder, but also 360°-rotatable relative to the lamp holder for illumination. Moreover, the lamp body may be folded for illumination. Therefore, the present invention realizes the omnidirectional illumination of the LED lamp through a simple structure.

It will be apparent to those skilled in the art that the present invention is not limited to the details of the exemplary embodiments described above, and the present invention can be embodied in other specific forms without departing from the spirit or essential characteristics thereof. Therefore, the embodiments should be considered in all respects as exemplary and nonrestrictive. The scope of the present invention is defined by the appended claims rather than the foregoing description, so it is intended to cover all changes falling within the meaning and range of equivalent elements of the appending claims. Any reference numeral in the claims should not be regarded as limiting the involved claims.

The invention claimed is:

1. A retractable rotatable LED lamp, comprising:

a lamp holder, a lamp body, and a retractable rotatable mechanism, wherein the lamp body is retractable and rotatable on the lamp holder by the retractable rotatable mechanism, wherein the retractable rotatable mechanism comprises a gear seat arranged on the lamp body;

a central hole of the gear seat is provided with a gear;

two sides of the central hole are symmetrically provided with deep holes;

each of the deep holes is provided with a first elastic body;

a first end of the first elastic body contacts a bottom of the deep hole;

a second end of the first elastic body contacts a latch;

the latch and the gear are engaged;

a first end of a retractable rod is connected to the gear;

a second end of the retractable rod is hinged with a threaded rod;

the threaded rod is arranged on a fixing box;

a first convex column and a second convex column extend out from two sides of the fixing box, respectively;

a second elastic body is arranged between the first convex column and the second convex column;

two sides in a lamp housing of the lamp holder are symmetrically provided with a first convex column guide rail and a second convex column guide rail;

the first convex column guide rail or the second convex column guide rail comprises a first groove, a concave strip connected to the first groove, and a second groove connected to the concave strip;

the first convex column contacts the first convex column guide rail;

the second convex column contacts the second convex column guide rail; and a lamp cover of the lamp holder is provided with an opening for the threaded rod to be folded and fitted in.

2. The retractable rotatable LED lamp according to claim 1, wherein a plurality of elastic pads and an adjusting nut are sleeved on the threaded rod.

3. The retractable rotatable LED lamp according to claim 1, wherein an upper part and a lower part inside the lamp housing are respectively provided with a guide strip and a guide column; and the guide strip and the guide column are respectively matched with a guide strip groove and a guide column groove on the fixing box.

4. The retractable rotatable LED lamp according to claim 1, wherein the bottom of the lamp housing is provided with a magnetic body.

5. The retractable rotatable LED lamp according to claim 4, wherein the lamp body comprises a shell, and a front part of the shell is provided with an LED light.

6. The retractable rotatable LED lamp according to claim 5, wherein the shell is further provided with a battery for supplying power to the LED light.

7. The retractable rotatable LED lamp according to claim 6, wherein the shell is provided with at least one hook.

8. The retractable rotatable LED lamp according to claim 7, wherein the hook is hidden in a hook slot of the shell.

9. The retractable rotatable LED lamp according to claim 4, wherein the first elastic body and the second elastic body are springs.

10. The retractable rotatable LED lamp according to claim 4, wherein the opening set on the lamp cover is a one-way opening.

11. The retractable rotatable LED lamp according to claim 2, wherein the bottom of the lamp housing is provided with a magnetic body.

12. The retractable rotatable LED lamp according to claim 3, wherein the bottom of the lamp housing is provided with a magnetic body.

13. The retractable rotatable LED lamp according to claim 11, wherein the lamp body comprises a shell, and a front part of the shell is provided with an LED light.

14. The retractable rotatable LED lamp according to claim 12, wherein the lamp body comprises a shell, and a front part of the shell is provided with an LED light.

* * * * *